US011293261B2

(12) United States Patent
Yuan et al.

(10) Patent No.: US 11,293,261 B2
(45) Date of Patent: Apr. 5, 2022

(54) BUOYANCY ASSIST TOOL

(71) Applicant: HALLIBURTON ENERGY SERVICES, INC., Houston, TX (US)

(72) Inventors: Min Mark Yuan, Katy, TX (US); Stephen Allen Yeldell, Golden, CO (US); Lonnie Carl Helms, Humble, TX (US); Frank Vinicio Acosta, Spring, TX (US); Rajesh Parameshwaraiah, Houston, TX (US); Kevin Wendell Ardoin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 327 days.

(21) Appl. No.: 16/606,584

(22) PCT Filed: Dec. 21, 2018

(86) PCT No.: PCT/US2018/067161

§ 371 (c)(1),
(2) Date: Oct. 18, 2019

(87) PCT Pub. No.: WO2020/131104

PCT Pub. Date: Jun. 25, 2020

(65) Prior Publication Data

US 2021/0363858 A1 Nov. 25, 2021

(51) Int. Cl.
*E21B 34/06* (2006.01)
*E21B 33/12* (2006.01)
(Continued)

(52) U.S. Cl.
CPC ..... *E21B 34/063* (2013.01); *E21B 33/12* (2013.01); *E21B 43/082* (2013.01); *E21B 43/10* (2013.01)

(58) Field of Classification Search
CPC ..... E21B 34/063; E21B 33/12; E21B 43/082; E21B 43/10
See application file for complete search history.

(56) References Cited

U.S. PATENT DOCUMENTS 3,463,351 A 8/1969 Mills
3,779,263 A 12/1973 Edwards et al.
(Continued)

FOREIGN PATENT DOCUMENTS

EP 0566290 A1 10/1993
EP 0681087 B1 9/2000
(Continued)

OTHER PUBLICATIONS

International Search Report and Written Opinion dated Aug. 14, 2018, issued in PCT Application No. PCT/US2017/062528.
(Continued)

*Primary Examiner* — Giovanna Wright
*Assistant Examiner* — Yanick A Akaragwe
(74) *Attorney, Agent, or Firm* — McAfee & Taft

(57) ABSTRACT

A buoyancy assist tool has an outer case and a sleeve disposed in the outer case. The sleeve is movable from first to second positions in the outer case. A permeable membrane is attached to the movable sleeve at a lower end thereof. A rupture disk is mounted in the outer case. Fluid flow through the permeable membrane detaches the sleeve from the outer case and moves the sleeve from the first to the second position. In the second position, the sleeve creates an open bore for the passage of downhole tools therethrough.

18 Claims, 17 Drawing Sheets

(51) Int. Cl.
*E21B 43/08* (2006.01)
*E21B 43/10* (2006.01)

(56) References Cited

U.S. PATENT DOCUMENTS

| | | | |
|---|---|---|---|
| 3,980,134 | A | 9/1976 | Amancharla |
| 4,457,376 | A | 7/1984 | Carmody et al. |
| 5,150,756 | A | 9/1992 | Hassanzadeh |
| 5,479,986 | A | 1/1996 | Gano et al. |
| 5,765,641 | A | 6/1998 | Shy et al. |
| 5,826,661 | A | 10/1998 | Parker et al. |
| 6,026,903 | A | 2/2000 | Shy et al. |
| 6,076,600 | A | 6/2000 | Vick, Jr. et al. |
| 6,161,622 | A | 12/2000 | Robb et al. |
| 6,324,904 | B1 | 12/2001 | Ishikawa et al. |
| 6,450,263 | B1 | 9/2002 | Schwendemann |
| 6,505,685 | B1 | 1/2003 | Sullaway et al. |
| 6,622,798 | B1 | 9/2003 | Rogers et al. |
| 6,651,748 | B2 | 11/2003 | Sullaway et al. |
| 6,672,389 | B1 | 1/2004 | Hinrichs |
| 6,758,281 | B2 | 7/2004 | Sullaway et al. |
| 7,270,191 | B2 | 9/2007 | Drummond et al. |
| 8,505,621 | B2 | 8/2013 | Telfer et al. |
| 9,033,055 | B2 | 5/2015 | Mccoy et al. |
| 9,309,752 | B2 | 4/2016 | Talley et al. |
| 9,441,437 | B2 | 9/2016 | Fripp et al. |
| 9,441,446 | B2 | 9/2016 | Fripp et al. |
| 9,518,445 | B2 | 12/2016 | Noske |
| 9,540,904 | B2 | 1/2017 | Petrowsky |
| 9,593,542 | B2 | 3/2017 | Getzlaf et al. |
| 10,138,707 | B2 | 11/2018 | Tolman et al. |
| 10,323,478 | B2 | 6/2019 | Berscheidt et al. |
| 2002/0185273 | A1 | 12/2002 | Aronstam et al. |
| 2003/0116324 | A1 | 6/2003 | Dawson et al. |
| 2003/0217844 | A1 | 11/2003 | Moyes |
| 2008/0073075 | A1 | 3/2008 | Buyers et al. |
| 2008/0115942 | A1 | 5/2008 | Keller et al. |
| 2010/0270031 | A1 | 10/2010 | Patel |
| 2010/0294376 | A1 | 11/2010 | O'Brien et al. |
| 2011/0042099 | A1 | 2/2011 | Williamson, Jr. et al. |
| 2011/0253392 | A1 | 10/2011 | May et al. |
| 2012/0111566 | A1 | 5/2012 | Sherman et al. |
| 2014/0174757 | A1 | 6/2014 | Fripp et al. |
| 2014/0216756 | A1 | 8/2014 | Getzlaf et al. |
| 2014/0224505 | A1 | 8/2014 | Ramon |
| 2014/0338923 | A1 | 11/2014 | Fripp et al. |
| 2014/0360725 | A1* | 12/2014 | Xu ..... E21B 34/14 166/301 |
| 2015/0107843 | A1 | 4/2015 | Talley et al. |
| 2015/0129205 | A1 | 5/2015 | Hofman et al. |
| 2015/0240596 | A1 | 8/2015 | Horwell |
| 2016/0177668 | A1 | 6/2016 | Watson et al. |
| 2016/0333658 | A1 | 11/2016 | Keshishian et al. |
| 2017/0096875 | A1 | 4/2017 | Ravensbergen et al. |
| 2017/0138153 | A1 | 5/2017 | Getzlaf et al. |
| 2018/0003004 | A1 | 1/2018 | Norman et al. |
| 2018/0058179 | A1 | 3/2018 | Nuryaningsih et al. |
| 2018/0080308 | A1 | 3/2018 | Dedman et al. |
| 2018/0219200 | A1 | 8/2018 | Albukrek et al. |
| 2018/0262127 | A1 | 9/2018 | Gooneratne et al. |
| 2018/0371869 | A1 | 12/2018 | Kellner et al. |
| 2019/0128081 | A1 | 5/2019 | Ross et al. |
| 2019/0352994 | A1 | 11/2019 | Giroux |
| 2019/0352995 | A1 | 11/2019 | Giroux et al. |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Sep. 19, 2019, issued in PCT Application No. PCT/US2018/066889.
International Search Report and Written Opinion dated Aug. 23, 2019, issued in PCT Application No. PCT/US2018/064085.
International Search Report and Written Opinion dated Aug. 14, 2019, issued in PCT Application No. PCT/US2018/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/031541.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Sep. 19, 2019, issued in corresponding PCT Application No. PCT/US2018/067161.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.

* cited by examiner

BUOYANCY ASSIST TOOL

BACKGROUND

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

BRIEF DESCRIPTION OF THE DRAWINGS

FIG. 6 is a cross section of an additional embodiment of a buoyancy assist tool.

FIG. 8 is a cross-sectional view of the buoyancy assist tool of FIG. 6 after a plug has passed therethrough.

FIG. 13 is an additional embodiment of a buoyancy assist tool.

DESCRIPTION

Figure 1:
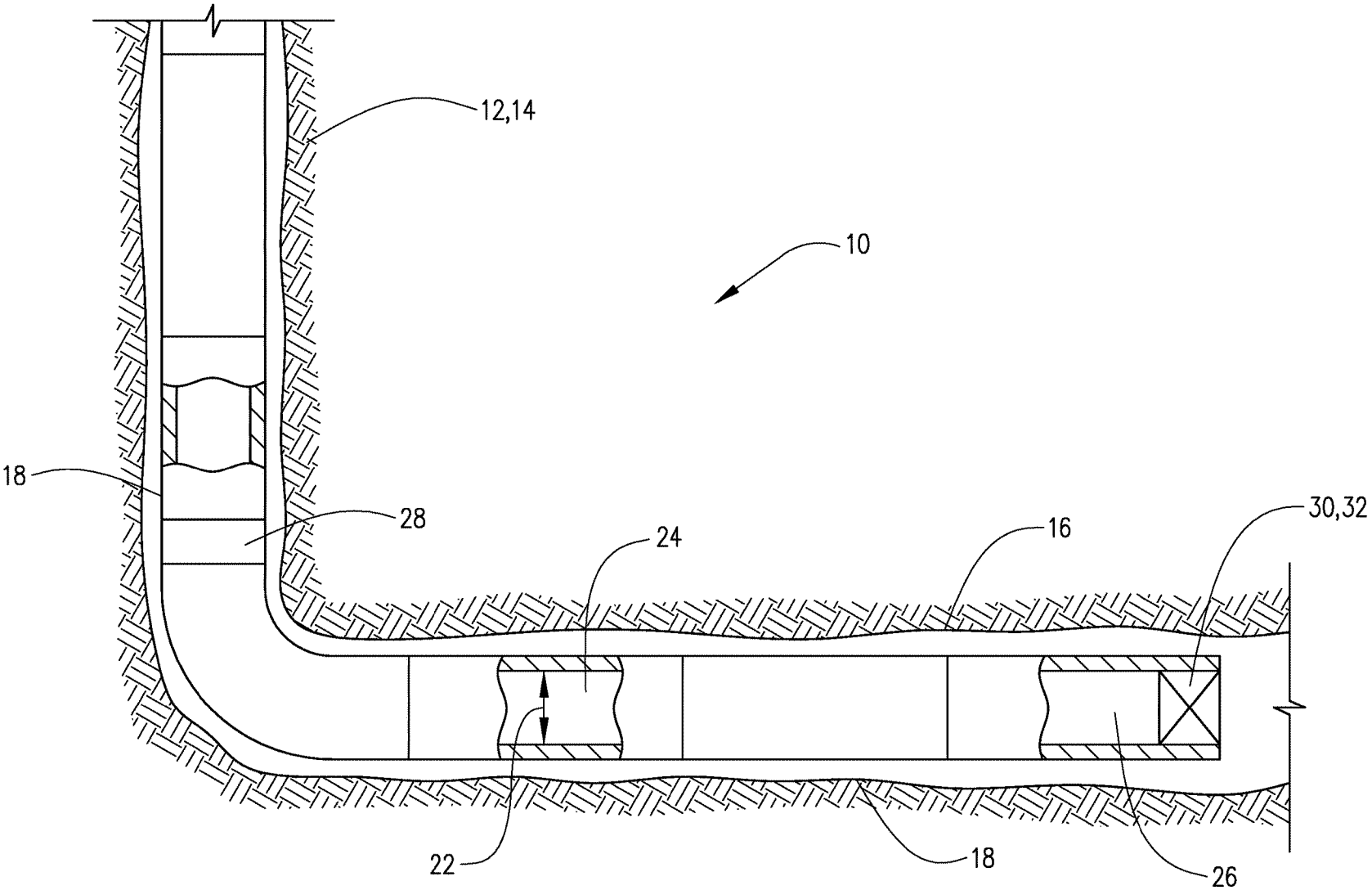
FIG. 1 is a schematic cross-section view of an exemplary well bore with a well casing including a buoyancy chamber therein.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these are used is a factor of the well conditions and the amount of buoyancy desired.

Lower boundary 30 may comprise a float device such as a float shoe or float collar. As is known, such float devices will generally allow fluid flow downwardly therethrough but will prevent flow upwardly into the casing. The float devices are generally a one-way check valve. The float device 30 will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 comprises an outer case 36 with upper end 38 and lower end 40. Buoyancy assist tool 34 is connected at upper end 38 and lower end 40 to a casing joint 20 and as a result comprises a part of casing string or well casing 18. Outer case 36 has an upper portion 42 and lower portion 44 which may be threadedly connected or connected by other means known in the art. Outer case 36 has an inner surface 46 defining central flow passage 48. Inner surface 46 includes a pair of grooves 50 which include an upper or first groove 52 and a second or lower groove 54. An upward facing shoulder 55 is defined on inner surface 46.

Figure 2:
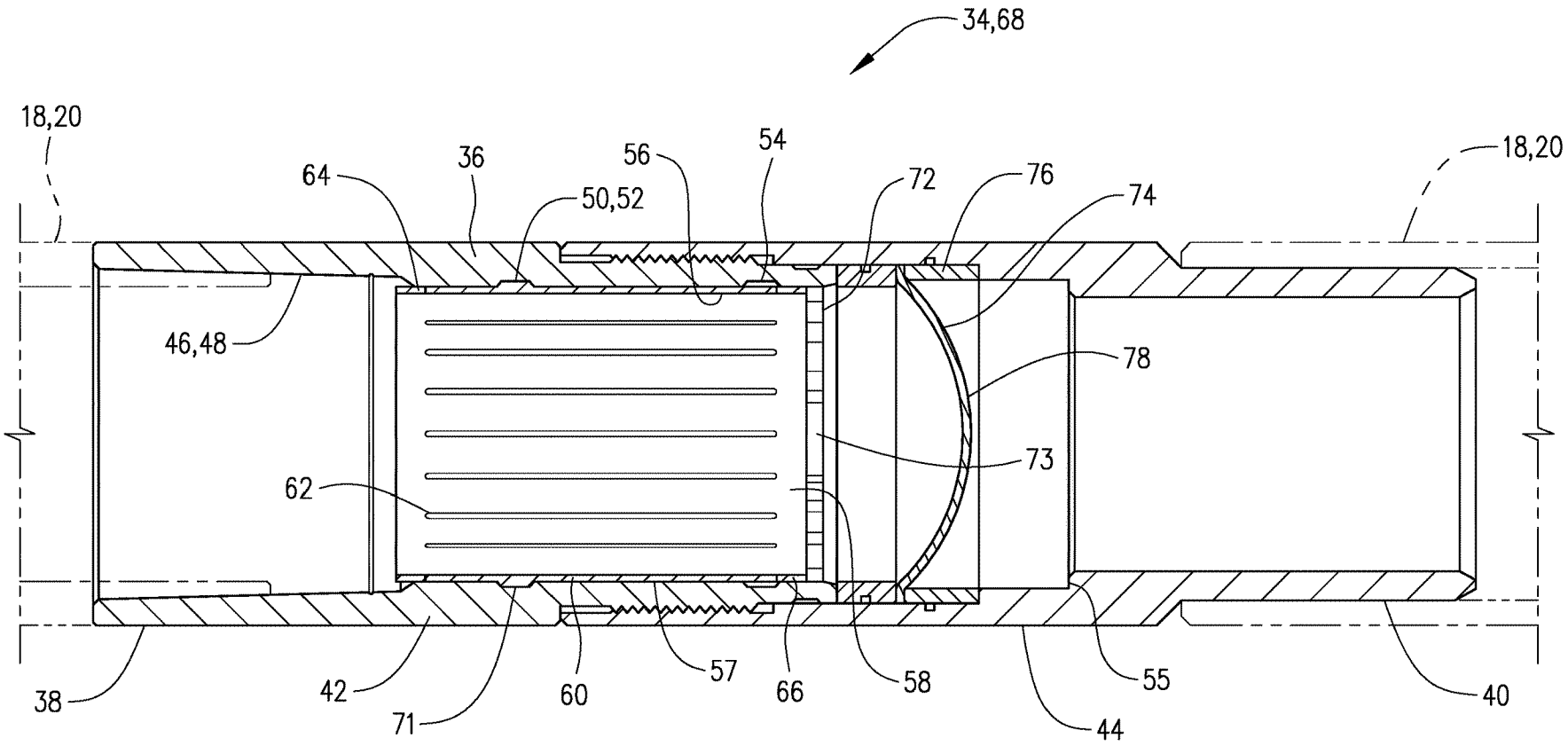
FIG. 2 is a cross section of the buoyancy assist tool of the current disclosure in a first position.
Figure 3:
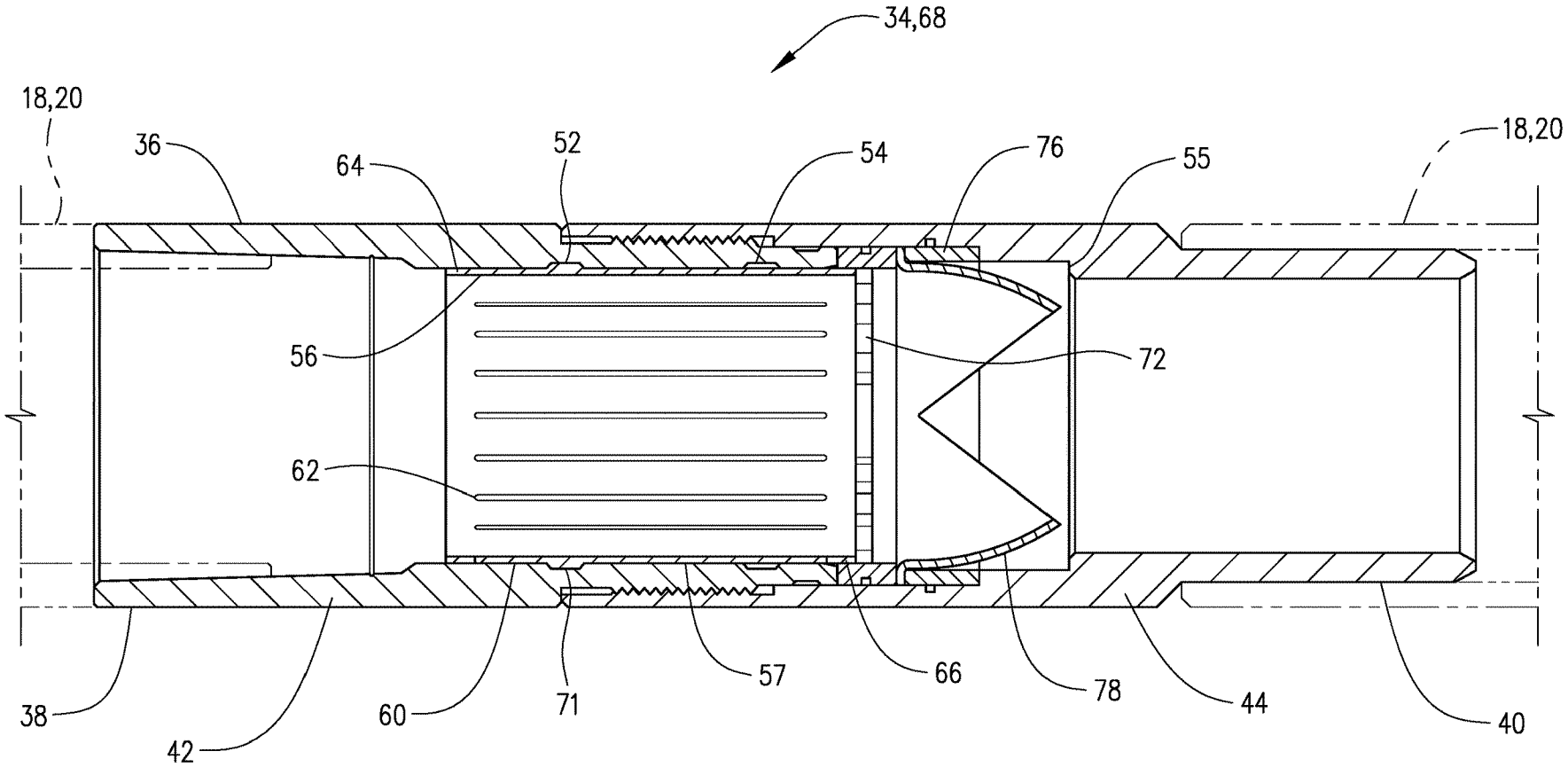
FIG. 3 is a cross section of a buoyancy assist tool of FIG. 2 after the rupture disk has been ruptured.

A sleeve 60, which may be a slotted sleeve 60 with slots 62, is disposed in outer case 36. Sleeve 60 has upper end 64 and lower end 66. Sleeve 60 has an inner surface 56 which defines a central opening or bore 58 therethrough. Sleeve 60 has outer surface 57. Sleeve 60 is shown in a first position 68 in FIG. 2 and in a second position 70 in FIG. 4. Buoyancy assist tool 34 has a mechanism to detachably connect sleeve 60 in the first position 68, which in the embodiment shown is outwardly extending collet heads 71 on outer surface 57 of sleeve 60, positioned between the upper and lower ends 64 and 66 of sleeve 60.

Figure 16:
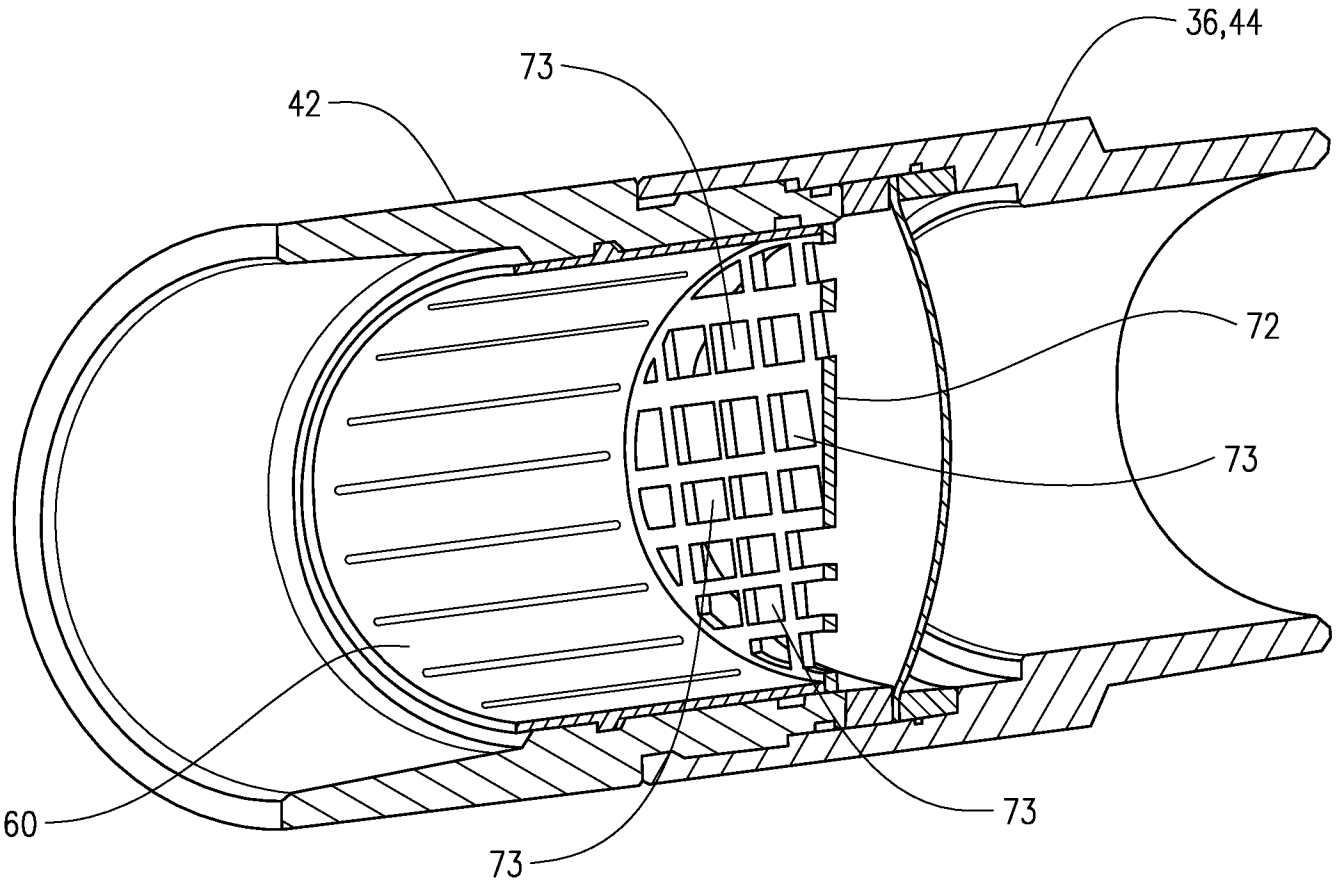
FIG. 16 is a cutaway showing an embodiment of a permeable membrane of the current disclosure.

A membrane 72 is attached to sleeve 60 and may be attached to the lower end 66 thereof. Membrane 72 is a permeable membrane that will allow fluid flow therethrough. Membrane 72 may be, for example, a screen or other permeable covering. FIG. 16 is an exemplary cutaway depiction of a membrane 72. Membrane 72 in the embodiment described is configured as a screen with openings 73 therethrough. Membrane 72 may be made of fabric, material, composite and may be a dissolvable material. Membrane 72 is positioned across the central flow passage 58 of sleeve 60. Buoyancy assist tool 34 includes a fluid barrier, which is a rupturable, or burstable barrier. In the embodiment described the fluid barrier is a rupture disk 74 which comprises a rupture disk body 76 and a rupture disk membrane 78.

In operation casing string 18 is lowered into well bore 12 to a desired location. Running a casing such as well casing 18 into deviated wells and long horizontal wells often results in significantly increased drag forces and may cause a casing string to become stuck before reaching the desired location in the well bore. For example, when the casing produces more drag forces than available weight to slide the casing down the well, the casing may become stuck. If too much force is applied to the casing string 18 some damage may occur. The buoyancy assist tool 34 described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into the horizontal portion 16 to the desired location.

Once the final depth is reached in well bore 12 fluid pressure in well casing 18 can be increased to a pressure at which the rupture disk 74 and specifically the rupture disk membrane 78 will burst. Once the rupture disk 74 bursts fluid will rush therethrough to fill buoyancy chamber 26. The fluid will pass through permeable membrane 72 and the force of the fluid acting on membrane 72 will pull sleeve 60 from the first position 68 to the second position 70. The fluid will create a sufficient force to pull the collet heads 71 from upper groove 52. In second position 70 the collet heads will snap outwardly into lower groove 54. Sleeve 60 will be held in place thereby in addition to being held in place by shoulder 55 defined on lower portion 44 of outer case 36. Once the sleeve 60 is moved to second position 70 a plug 79 will be displaced therethrough. The plug 79 will remove any portions of membrane 72 which may still exist after sleeve 60 is moved to second position 70. Plug 79 will be displaced through casing 18 including outer case 36 after the rupture disk is ruptured, and in most cases after sleeve 60 has moved to the second position. In the second position 70, the rupture disk membrane is trapped between sleeve 60 and the inner surface 46 of outer case 36. As a result the bore through casing 18 is opened and not blocked by any rupture disk remnants, or other impediments such that the tools described herein may be passed therethrough.

Figure 4:
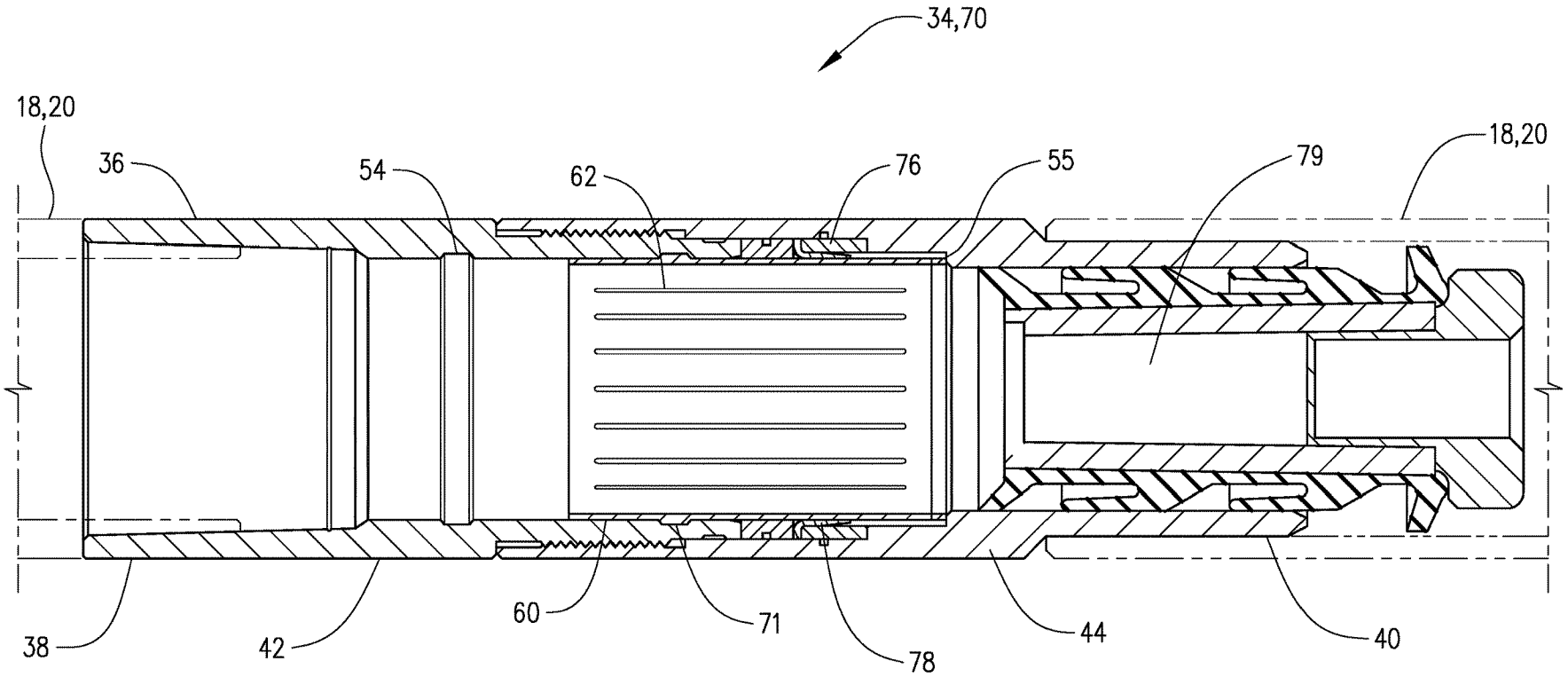
FIG. 4 is a cross section after the sleeve has been moved to a second position and a plug has been displaced therethrough.
Figure 5:
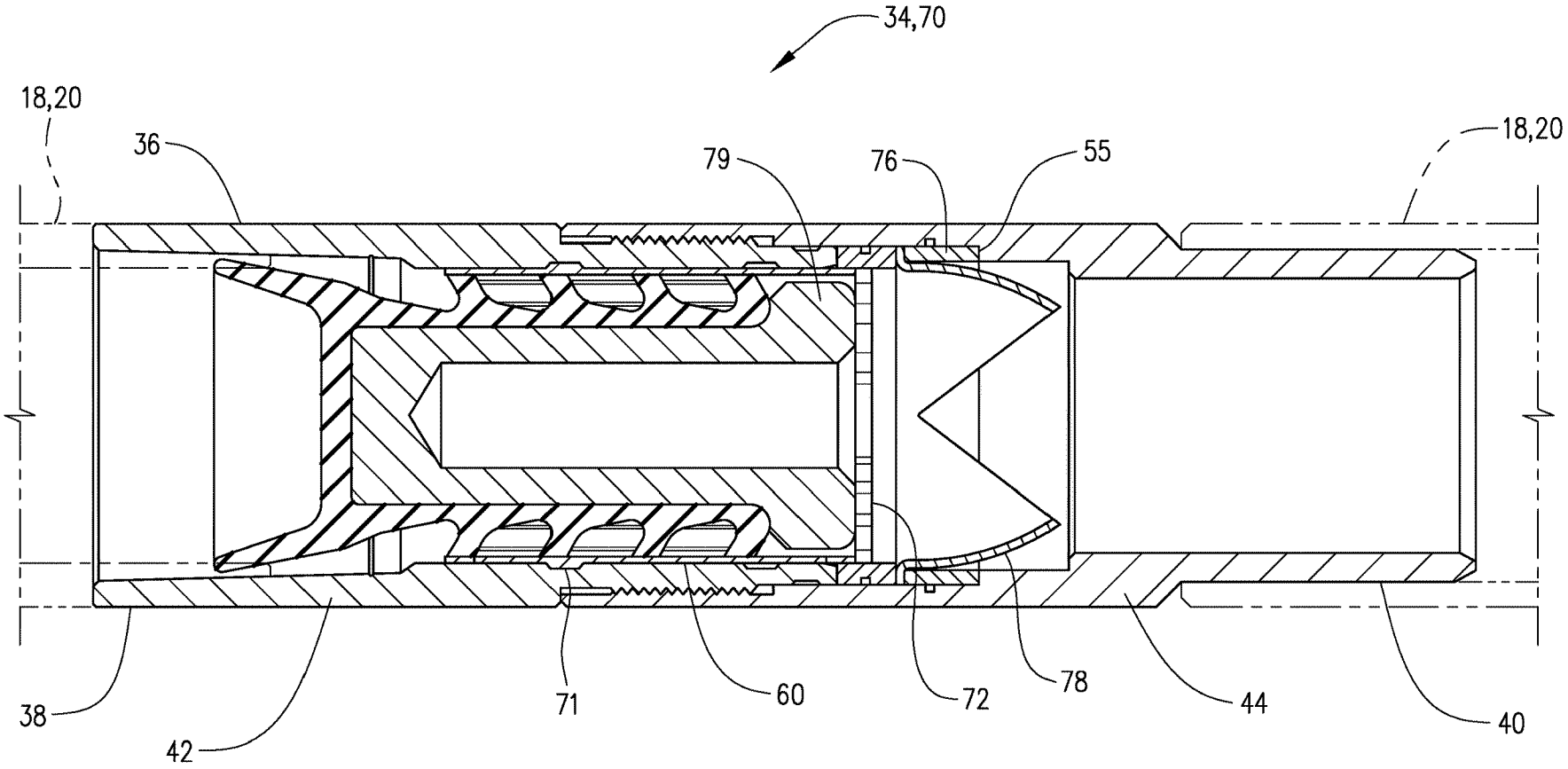
FIG. 5 is a cross-sectional view showing a plug displaced into the sleeve prior to the time the sleeve is moved to a second position.
Figure 5:
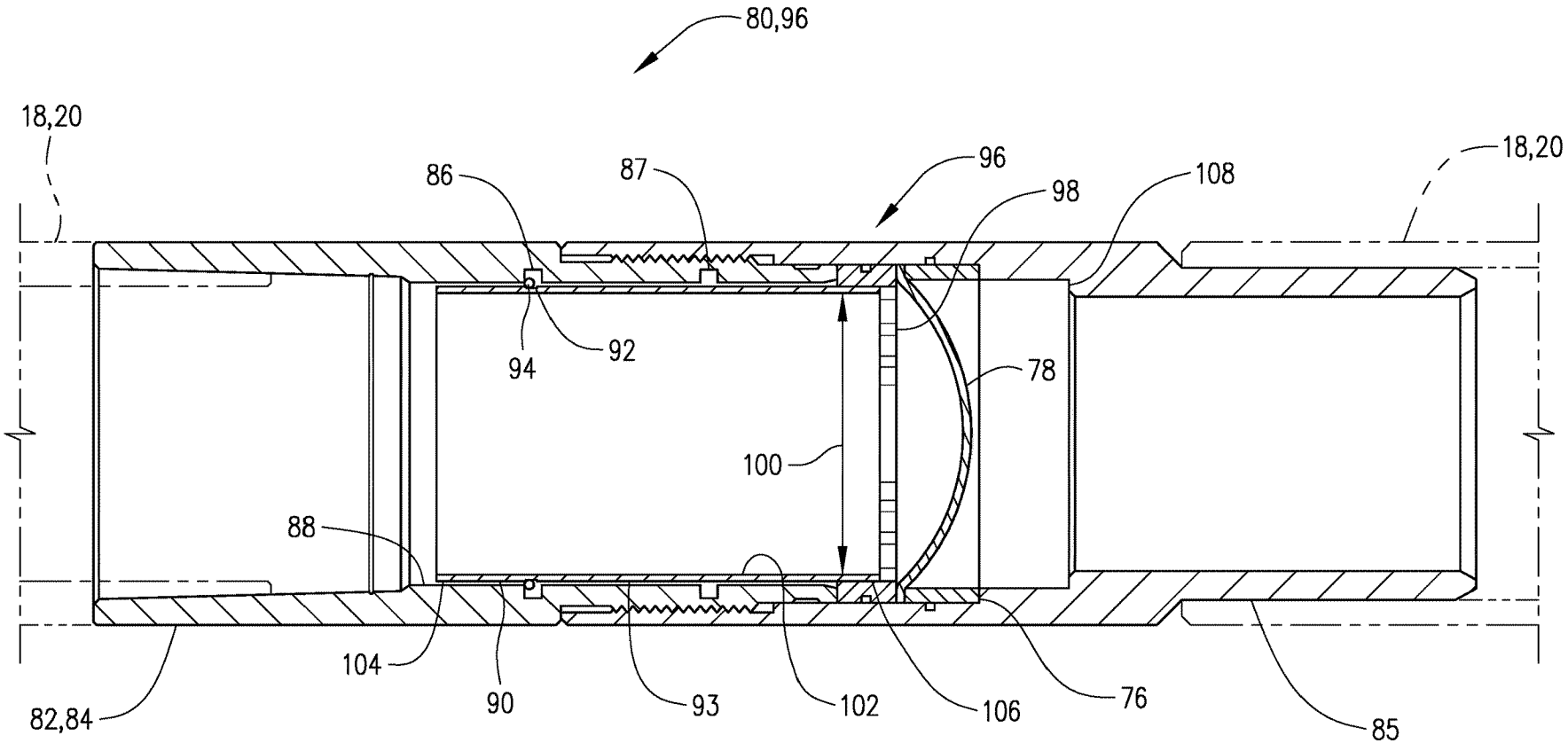
Figure 7:
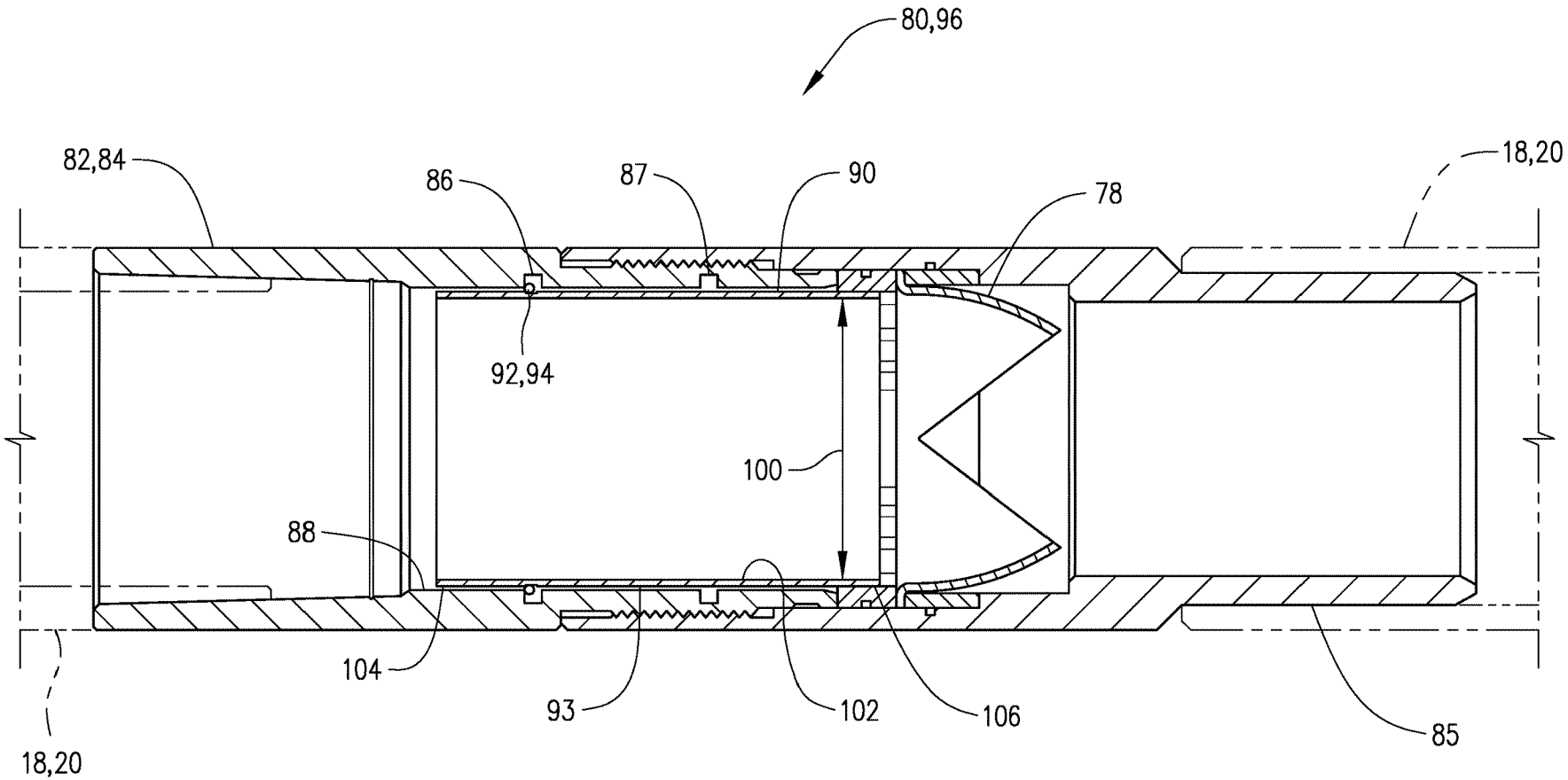
FIG. 7 is a cross-sectional view of the buoyancy assist tool of FIG. 6 after the ruptured disk has ruptured.

In a case where fluid flow through the membrane 72 does not move the sleeve 60 all of the way from first to the second positions 68 and 70 respectively, plug 79, as shown in FIG. 5, will engage membrane 72. Fluid pressure above plug 79 will urge plug 79 and sleeve 60 downwardly to the second position 70. Once second position 70 is reached fluid pressure will cause plug 79 to break through membrane 72 and plug 79 will be displaced through casing 18 as described herein. The position of the sleeve in second position 70 is shown in FIG. 4. The displacement of plug 79 into well casing 18 will ensure that sleeve 60 moves from the first and second positions. However, plug 79 is a failsafe and in normal operations the force of fluid flow through membrane 72 will be such that membrane 72 will pull sleeve 60 from the first position 68 to the second position 70. FIG. 5 shows the plug engaged with membrane 72. As described above, the buoyancy assist tool 34 may be configured such that it does not restrict the size of tools that can pass through the casing string beyond the restriction that exists as a result of the joints of the casing string itself. It is understood the list of tools and equipment provided herein is exemplary and is no way limiting.

An additional embodiment 80 of a buoyancy assist tool is shown in FIGS. 6 through 9. The operation of the embodiment of FIG. 6 is generally the same as that described with respect to the embodiment of FIG. 2. In the embodiment of FIG. 6 a locking ring is utilized to hold the sleeve into the first position prior to fluid flow passing therethrough. Buoyancy assist tool 80 includes an outer case 82 that has upper portion 84 and lower portion 85. Upper portion 84 has first and second grooves 86 and 87 in an inner surface 88 thereof. Sleeve 90 has a groove 92 in an outer surface 93 thereof. Buoyancy assist tool 80 has a mechanism to detachably connect sleeve 90 in a first position 96, which in the embodiment shown is lock ring, or snap ring 94 disposed in groove 92. Sleeve 90 is shown in the first position 96 in FIG. 6 and is moved to the second position 97 in FIG. 8.

A membrane 98 which is like that described with respect to membrane 72 is positioned across the opening 100 defined by an inner surface 102 of sleeve 90. Sleeve 90 has upper end 104 and lower end 106. In the embodiment described membrane 90 is positioned at lower end 106. The operation of the embodiment of FIG. 6 is like that described with respect to FIG. 2. Buoyancy assist tool 80 includes a fluid barrier, which is a rupturable, or burstable barrier. In the embodiment described the fluid barrier is a rupture disk 74 which comprises a rupture disk body 76 and a rupture disk membrane 78. Fluid pressure will be increased until rupture disk membrane 78 bursts. Fluid will rush through membrane 98 as buoyancy assist chamber 26 evacuates. The force of the fluid passing through membrane 98 will cause membrane 98 to pull sleeve 90 from the first position 96 to the second position 97. The lock ring 94 will snap outwardly into second groove 87 and lower end 106 will engage an upwardly facing shoulder 108 on lower portion 85 of outer case 82.

Figure 9:
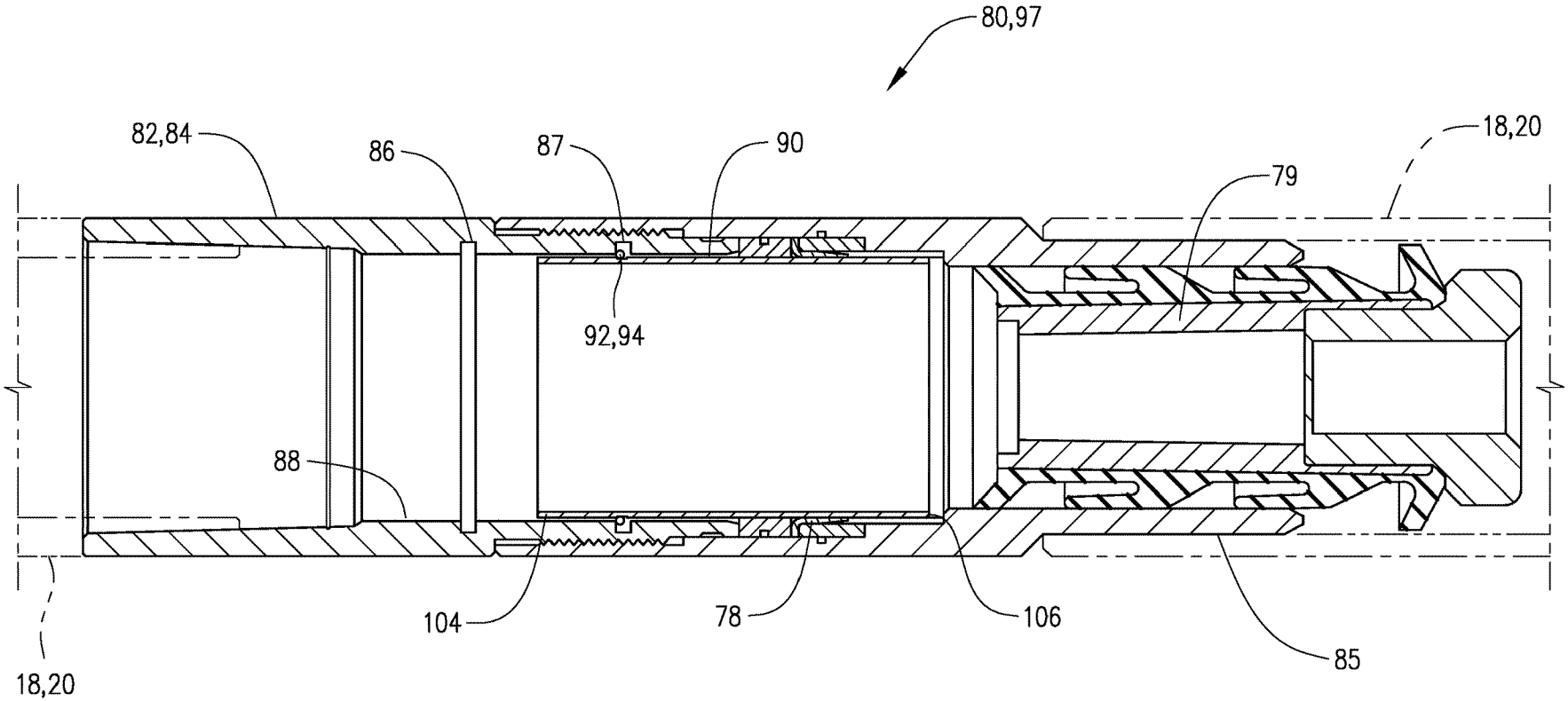
FIG. 9 is a cross-sectional view of the buoyancy assist tool of FIG. 6 after the plug has been displaced into the sleeve prior to the time the sleeve has moved to the second positon.
Figure 5:
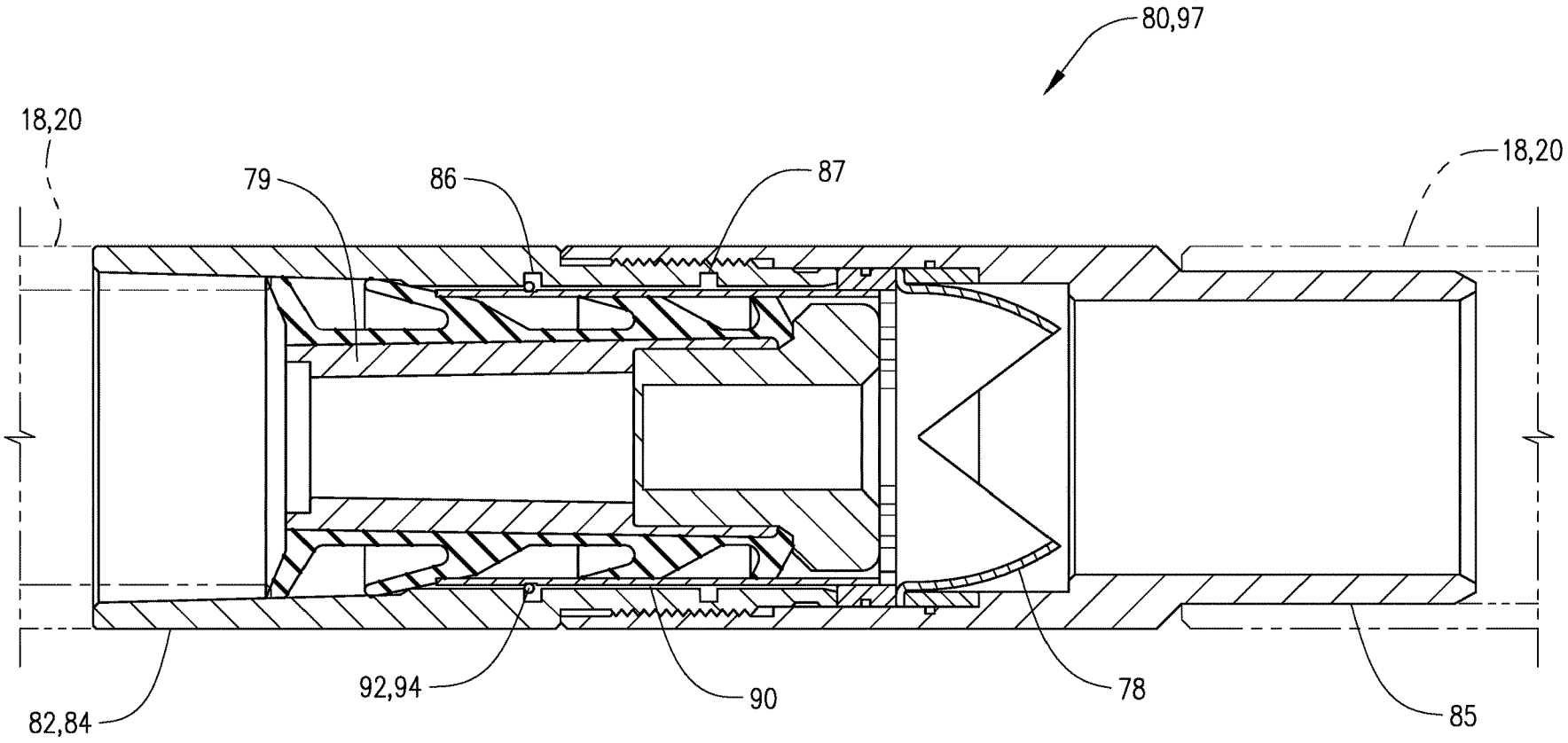

In the second position shown in FIG. 8 the rupture disk membrane 78 will be trapped between sleeve 90 and outer case 82. The plug 79 displaced therethrough will remove any remnants of membrane 98 and will leave an open bore for the passage of tools as described herein. As with the embodiment described with respect to FIG. 2, plug 79 may also be used as a failsafe to urge the sleeve 90 from the first to the second position 96 and 97 respectively, if the fluid flow through membrane 98 is insufficient to do so. FIG. 9 shows plug 79 engaged with membrane 98 before sleeve 90 reaches second position 97. Fluid pressure in well casing 18 will push plug 79 and sleeve 90 downward to second position 97. Plug 79 will pass downward through well casing 18, such that an open buoyancy assist tool 80 provides an open bore therethrough for the passage of tools therethrough as described above and may be configured such that it does not restrict the size of tools that can pass through the casing string beyond the restriction that exists as a result of the joints of the casing string itself. It is understood the list of tools and equipment provided herein is exemplary and is no way limiting.

Figure 10:
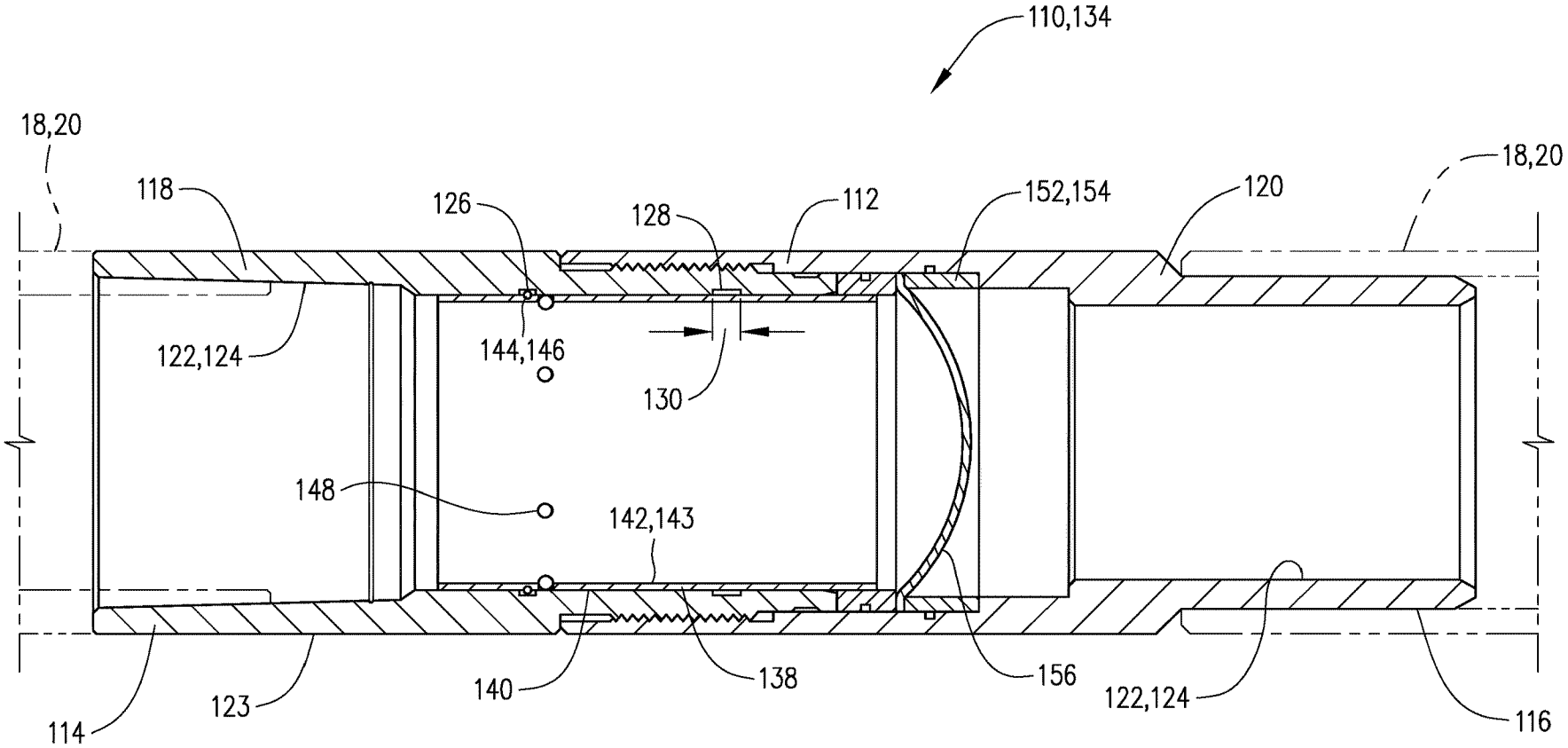
FIG. 10 is a cross-sectional view of an additional embodiment of a buoyancy assist tool.
Figure 11:
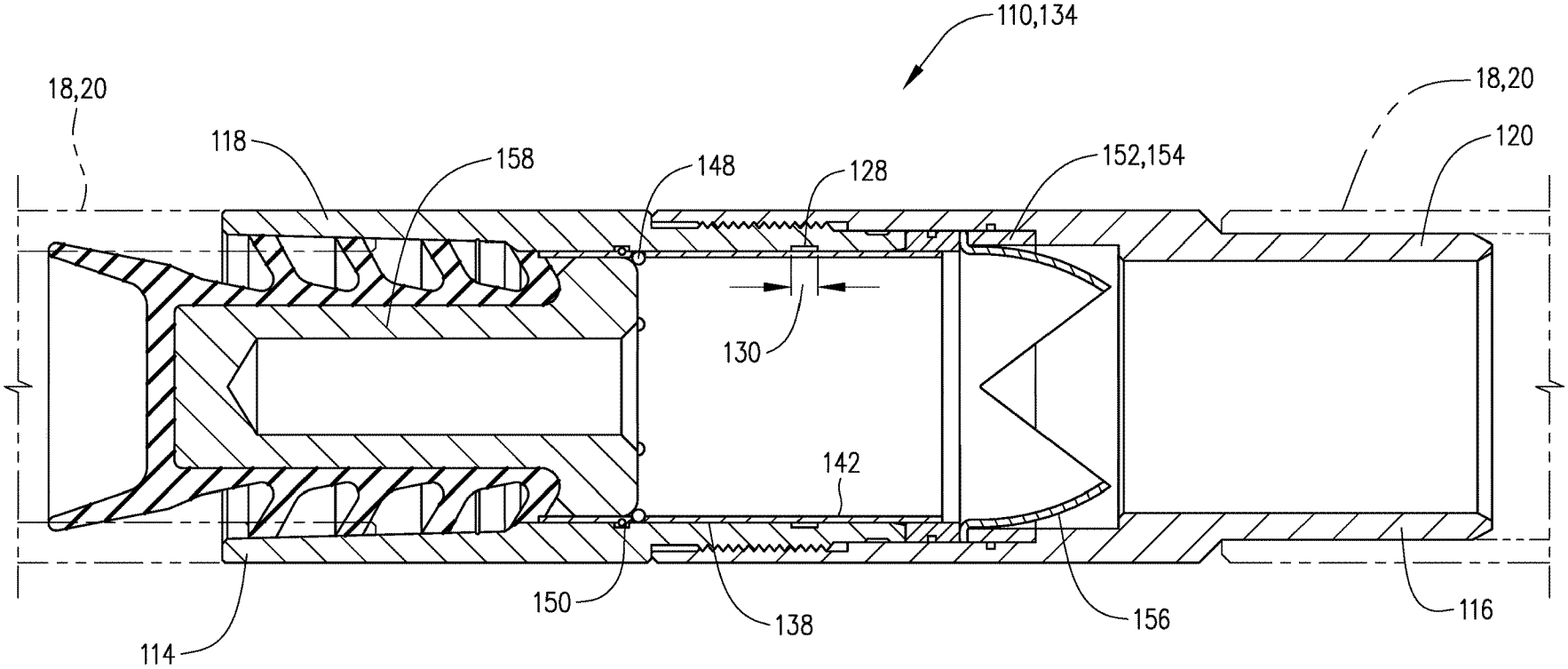
FIG. 11 is a cross-sectional view of the embodiment of FIG. 10 with a plug displaced into the buoyancy assist tool after the ruptured disk has ruptured.
Figure 12:
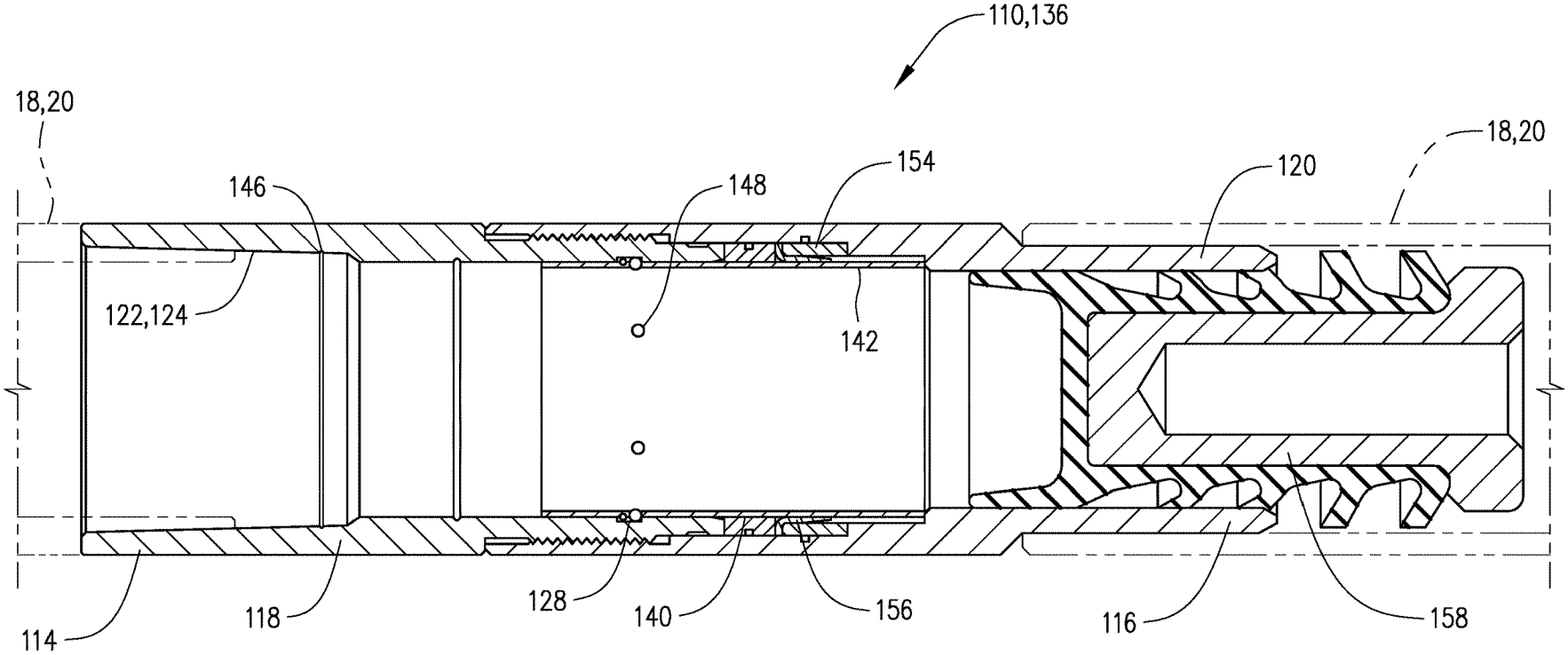
FIG. 12 is a cross-sectional view of the buoyancy assist tool of FIG. 10 after the sleeve has been shifted into the second position.

An additional embodiment of a buoyancy assist tool is shown in FIG. 10. Buoyancy assist tool 110 includes an outer case 112 with upper end 114 and lower end 116. Outer case 112 has upper portion 118 connected to a lower portion 120 by threading or other connection means known in the art. Outer case 112 has inner surface 122 defining a flow passage 124 therethrough, and has outer surface 123. Outer case 112 may comprise an upper or first groove 126 and a second or lower groove 128 defined in inner surface 122. Lower groove 128 has a length 130. Buoyancy assist tool 110 has a sleeve 138 movable from a first position 134 to a second position 136 in outer case 112. Sleeve 138 has an outer surface 140 and an inner surface 142. Inner surface 142 defines an opening 143 therethrough defining a flow path through sleeve 138, and is a part of the flow passage 124 through buoyancy assist tool 110. Outer surface 140 has a groove 144 therein. Buoyancy assist tool 110 has a mechanism to detachably connect sleeve 138 in the first position 134, which in the embodiment shown is a snap ring 146 positioned in groove 144 in sleeve 138 and in groove 126 in outer case 112.

Figure 17:
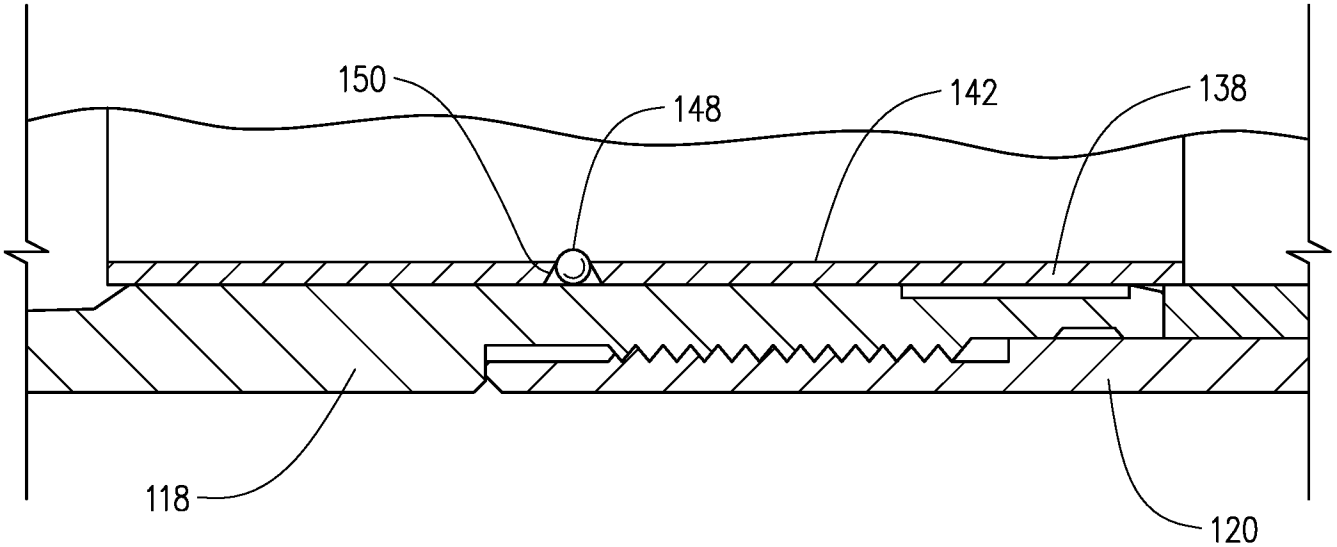
FIG. 17 is an enlarged view of a mechanism for engaging a plug displaced into the buoyancy assist tools of FIGS. 10 and 13.

Buoyancy assist tool 110 has an engagement device for engaging a plug displaced in the well casing 18 and into sleeve 138. The engagement device may be a retractable engagement device and in the embodiment described comprises a plurality of spherical balls 148 extending beyond inner surface 142 into the opening 143 defined by the inner surface 142 of sleeve 138. Spherical balls 148 are spaced circumferentially about sleeve 138. Spherical balls 148 are held in place by tapered openings 150 defined in the wall of sleeve 138 as shown in FIG. 17. Buoyancy assist tool 110 includes a fluid barrier, which is a rupturable, or burstable barrier. In the embodiment described the fluid barrier comprises a rupture disk 152 that comprises a rupture disk body 154 and a rupture disk membrane 156.

In operation a casing string 18 with buoyancy assist tool 110 is lowered into well bore 12 to a desired location. As described above the buoyancy assist tool will aid in lowering the casing string 18 into the deviated or horizontal portion 16 of a well bore 12. Once the casing string 18 is the desired location pressure is increased to rupture the rupture disk membrane 156. A plug 158 is displaced into the casing 18 thereafter. The plug will pass into outer case 112 and sleeve 138 and will engage the spherical balls 148. Pressure will be increased to detach sleeve 138 from outer case 112 and to move sleeve 138 from the first position 134 to the second position 136. Spherical balls 148 will be urged radially outwardly by plug 158 and will retract into groove 128. Length 130 of groove 128 is such that in the second position 136 both the snap ring 146 and the spherical balls 148 will be pressed out into lower groove 128. Plug 158 will pass completely through sleeve 138. In the second position 136 the rupture disk membrane 156 is trapped between sleeve 138 and the inner surface 122 of outer case 112. As a result buoyancy assist tool 110 provides for an open passage for the displacement of downhole tools as described above and may be configured such that it does not restrict the size of tools that can pass through the casing string beyond the restriction that exists as a result of the joints of the casing string itself. It is understood the list of tools and equipment provided herein is exemplary and is no way limiting. Length 130 of groove 128 is such that the snap ring 146 and spherical balls will be received therein in the second position 136.

Figure 15:
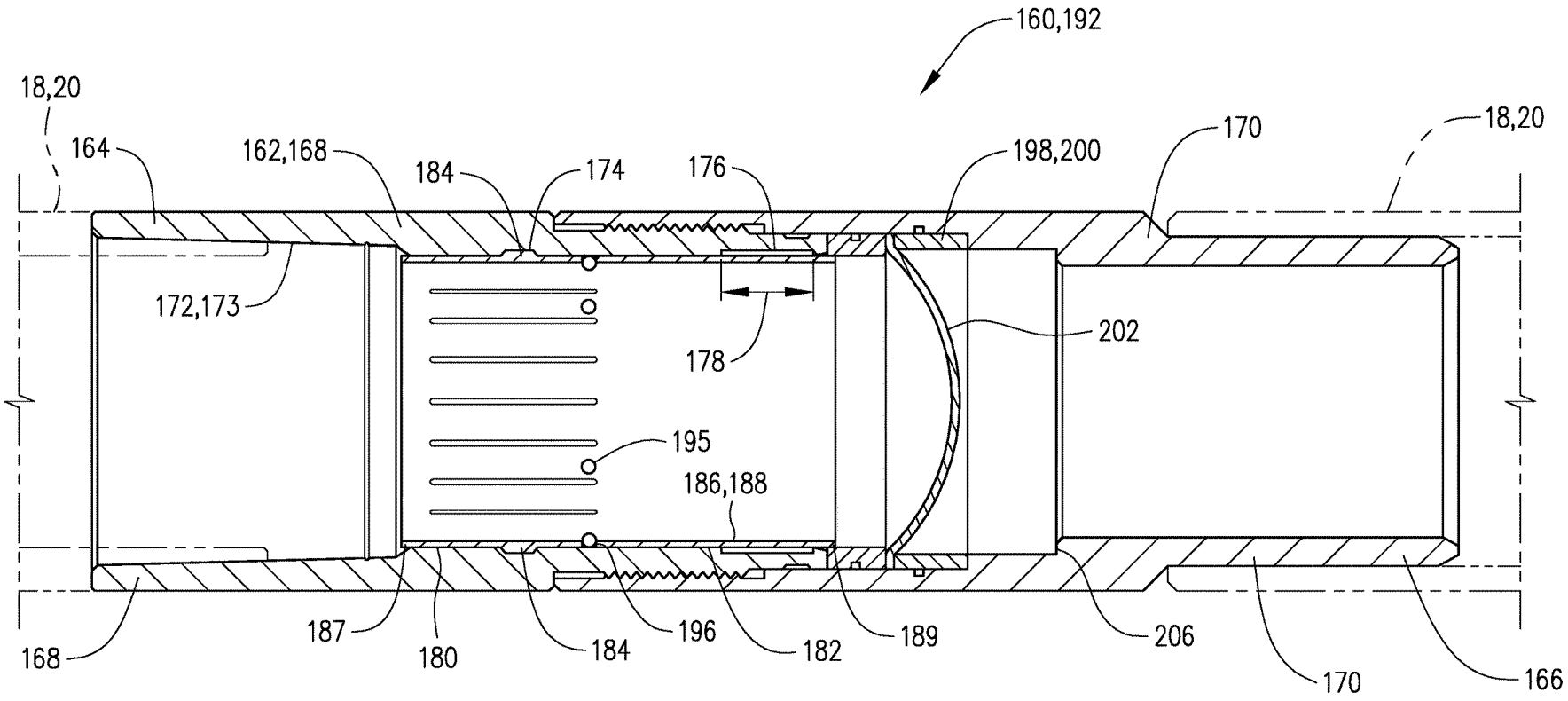
FIG. 15 is a cross-sectional view of the buoyancy assist tool of FIG. 13 after a plug has passed.
Figure 14:
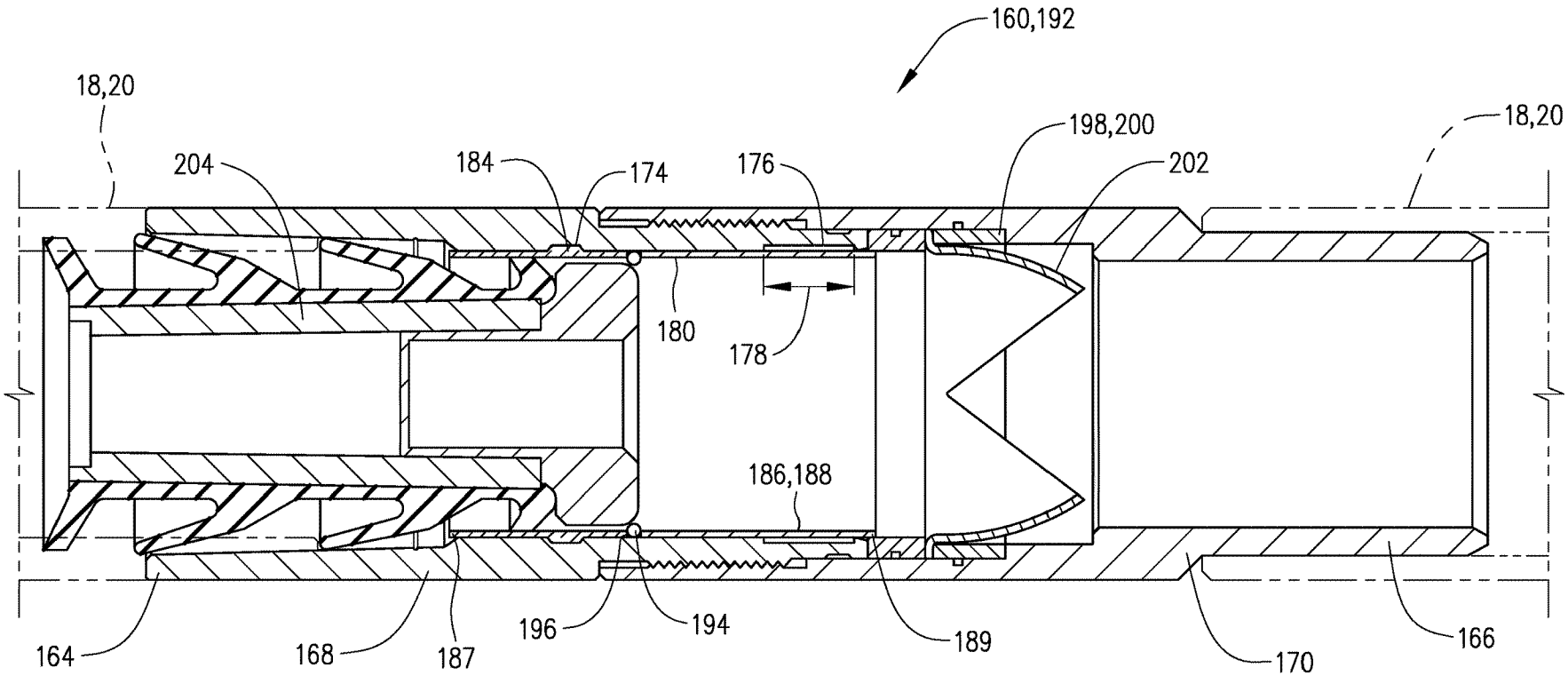
FIG. 14 is cross-sectional view of the buoyancy assist tool of FIG. 13 after a plug has been displaced into the sleeve.
Figure 15:
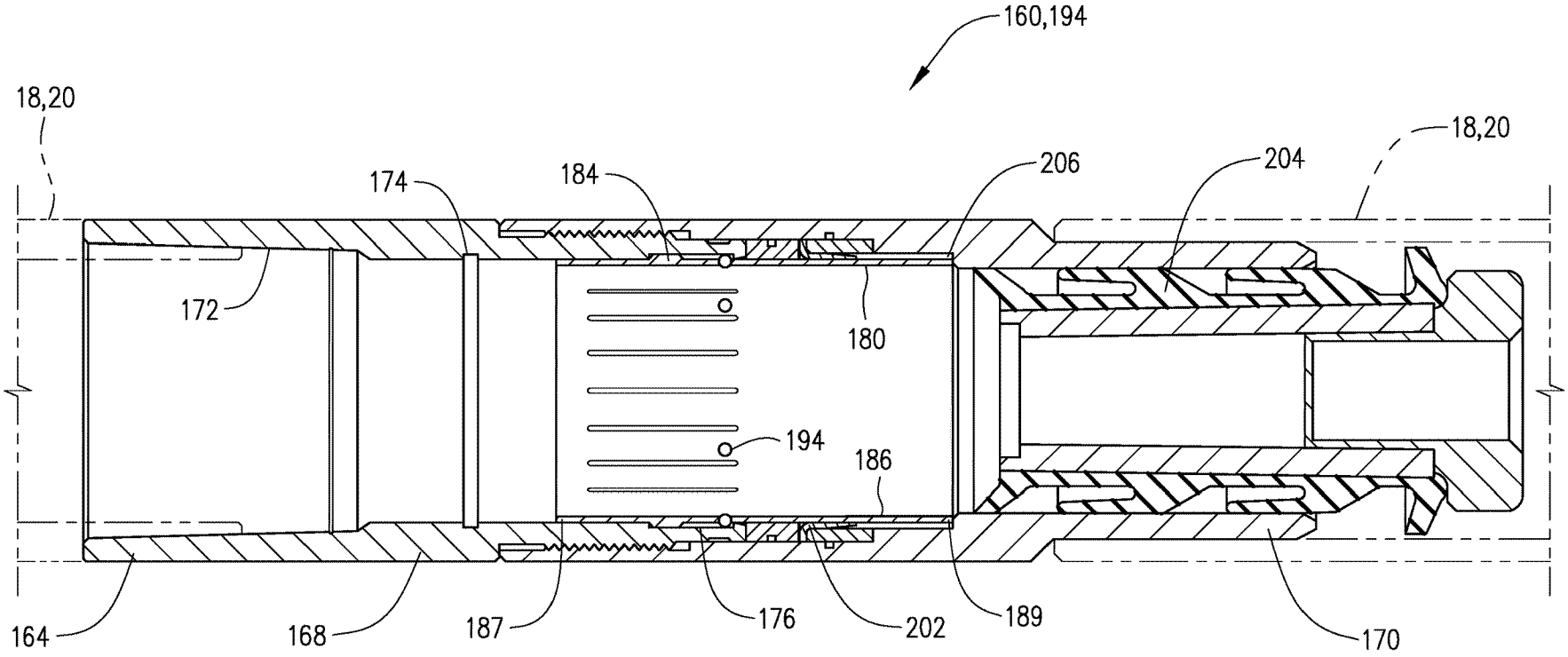

An additional embodiment of a buoyancy assist tool 160 is shown in FIGS. 13 through 15. Buoyancy assist tool 160 has outer case 162 with upper end 164 and lower end 166. Upper and lower ends 164 and 166 are configured to connect to casing string 18. Outer case 162 has upper portion 168, lower portion 170 and inner surface 172. Inner surface 172 defines a flow passage 173 therethrough. Inner surface 172 has upper or first groove 174 and second or lower groove 176 therein. Lower groove 176 has a length 178.

A collet sleeve 180 which may be a slotted sleeve 180 is disposed in outer case 162. Sleeve 180 has an outer surface 182 with collet heads 184 thereon. Buoyancy assist tool 110 has a mechanism to detachably connect sleeve 180 in a first position 192. Collet heads 184 are received in upper groove 174 in the first position 192 of the sleeve 180 and detachably connect sleeve 180 to outer case 162. Sleeve 180 has inner surface 186 defining a central opening 188. Sleeve 180 has upper end 187 and lower end 189. Sleeve 180 is movable in outer case 162 from the first position 192 to second position 194 thereof. Thus, sleeve 180 is detachably connected to outer case 162 which may comprise a portion of casing string 18.

Buoyancy assist tool 160 has an engagement device for engaging a plug displaced in the well casing 18 and into sleeve 180. The engagement device may be a retractable engagement device and in the embodiment described comprises a plurality of spherical balls 195 spaced circumferentially about sleeve 180. In the first position 192 spherical balls 195 extend inwardly into central opening 188. Spherical balls are held in place by tapered openings 196, which are configured like tapered openings 150 as described with respect to the embodiment of FIG. 10. Spherical balls 195 in the first position 192 are trapped between the inner surface 172 of outer case 162 and tapered opening 196 which is small enough to prevent spherical balls 195 from passing therethrough. Buoyancy assist tool 160 includes a fluid barrier, which is a rupturable, or burstable barrier. In the embodiment described the fluid barrier comprises a rupture disk 198 that comprises a rupture disk body 200 and a rupture disk membrane 202.

In operation pressure is increased in casing 18 until the pressure sufficient to burst rupture disk membrane 202 is reached. Once that occurs a plug 204 is displaced in the casing 18 and will engage spherical balls 194. Continued pressure applied to plug 204 will detach sleeve 180 from outer case 162 and will move sleeve 180 to the second position 194. Collet heads 184 will be pulled from groove 174 and will snap out into groove 176. Spherical balls 195 will be urged radially outwardly by plug 204 and will retract into groove 176. Length 178 of groove 176 is such that collet heads 184 and spherical balls 195 will both be received therein. In the second position 194 lower end 189 of sleeve 180 may engage an upward facing shoulder 206 defined in outer case 162. In second position 194 the rupture disk membrane 202 is trapped between the inner surface 172 of outer case 162 and outer surface 182 of sleeve 180. As a result the buoyancy assist tool 160 provides not only for the upper boundary of the buoyancy chamber 26 but also provides for an open bore for a passage of tools as described herein once the casing 18 has reached its desired location and the upper boundary and buoyancy assist tool 160 has been opened to evacuate the buoyancy chamber 26. As described above, the buoyancy assist tool 160 may be configured such that it does not restrict the size of tools that can pass through the casing string beyond the restriction that exists as a result of the joints of the casing string itself. It is understood the list of tools and equipment provided herein is exemplary and is no way limiting.

It is understood that each of the embodiments of a buoyancy assist tool described herein, namely buoyancy assist tools 34, 80, 110 and 160 when used with a well casing 18 will comprise the upper boundary 28 of buoyancy chamber 26.

A buoyancy assist tool of the current disclosure comprises an outer case and a sleeve disposed in the outer case and movable from first to second position in the outer case. In one embodiment a permeable membrane is attached to the movable sleeve at a lower end thereof. A rupture disk is mounted in the outer case. Fluid flow through the permeable membrane detaches the sleeve from the outer case and moves the sleeve from the first to the second position. In some embodiments a plug may be displaced into the sleeve to engage the permeable membrane to move the sleeve into the second position in the outer case.

In some embodiments the sleeve comprises a slotted sleeve that may be, for example, a collet sleeve. Collet heads will hold the slotted sleeve in the first position until sufficient force is applied to detach the sleeve and move the collet heads out of a groove in the outer case. In the second position, a rupture disk membrane of the rupture disk is trapped between the outer case and the sleeve.

In an additional embodiment, a downhole apparatus comprises a well casing with a fluid containment barrier therein. A rupture disk is spaced upwardly from the fluid containment barrier. The rupture disk and fluid containment barrier define a buoyancy chamber therebetween. A movable sleeve is disposed in the casing above the rupture disk and is movable from a first position to a second position in the well casing. The sleeve defines a flow passage therethrough, and a screen is positioned across the flow passage.

The rupture disk is configured to burst at a predetermined pressure. In some embodiments fluid flow through the screen after the rupture disk bursts will pull the sleeve from the first position toward the second position and a plug is displaced through the sleeve after it has moved out of the first position.

In some embodiments a plug configured to pass into the flow passage of the sleeve will engage the sleeve and shift the sleeve from the first to the second position. In the second position the sleeve traps the rupture disk against the casing. The buoyancy assist tool comprises an upper end of a buoyancy chamber in a well casing.

In another embodiment, a buoyancy assist tool comprises an outer case and a sleeve disposed in the outer case and movable from a first position to a second position in the outer case. A retractable engagement mechanism is operably associated with the sleeve, and is configured to engage a plug displaced into the outer case. A rupturable fluid barrier is positioned in the outer case below the retractable engagement mechanism.

In one embodiment the rupturable fluid barrier is a rupture disk. The outer case comprises upper and lower grooves and in the second position of the sleeve the retractable engagement device is received in the lower groove. A lock ring is received in the upper groove to detachably connect the sleeve to the outer case in the first position of the sleeve. In the second position the lock ring and the retractable engagement device are both received in the lower groove. A rupture disk membrane of the rupture disk is trapped between the sleeve and the outer case in the second position of the sleeve. In an additional embodiment a downhole apparatus comprises a well casing and a fluid containment barrier in the well casing.

The fluid containment barrier may comprise, for example float equipment such as a float shoe or float collar. The rupturable fluid barrier and fluid containment barrier define a buoyancy chamber therebetween. The retractable engagement mechanism, which in one embodiment may be a plurality of spherical balls spaced circumferentially about the sleeve, is configured to engage a plug displaced into the well casing.

A plug displaced into the well casing is configured to engage the retractable engagement device. Fluid pressure applied in the casing will urge the plug and the retractable engagement device downwardly. In the unretracted position, the plug will engage the retractable engagement device and will urge the sleeve downwardly and move the sleeve from the first to the second position. When the sleeve reaches the second position, the retractable engagement device will be retracted radially outwardly and will be received in a lower groove in the outer case. The plug will pass through the sleeve and the well casing, leaving an open bore for the passage of well tools. In one embodiment the retractable engagement device is pressed outwardly into a lower groove defined in the casing in the second position of the sleeve. In the second position of the sleeve a rupture disk membrane of the rupture disk is trapped between the outer case and the sleeve.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A buoyancy assist tool comprising:
an outer case;
a sleeve disposed in the outer case and movable from first to second position in the outer case;
a permeable membrane attached to the movable sleeve; and
a rupture disk mounted in the outer case, wherein a rupture disk membrane of the rupture disk is trapped between the outer case and the sleeve in the second position thereof.

2. The buoyancy assist tool of claim 1, wherein fluid flow through the permeable membrane moves the sleeve from the first to the second position.

3. The buoyancy assist tool of claim 1, the sleeve comprising a slotted sleeve.

4. The buoyancy assist tool of claim 3, the slotted sleeve comprising a collet sleeve.

5. The buoyancy assist tool of claim 1, wherein the permeable membrane is dissolvable.

6. A downhole apparatus comprising:
a well casing;
a fluid containment barrier in the well casing;
a rupture disk configured to burst at a predetermined pressure spaced upwardly from the fluid containment barrier, the rupture disk and the fluid containment barrier defining a buoyancy chamber therebetween;
a sleeve disposed in the casing above the rupture disk and movable from a first position to a second position in the well casing, the sleeve defining a longitudinal flow passage therethrough; and
a screen positioned across the longitudinal flow passage, wherein fluid flow through the screen after the rupture disk bursts will pull the sleeve from the first position toward the second position.

7. The downhole apparatus of claim 6, further comprising a plug configured to pass into the flow passage of the sleeve and engage the screen, wherein the plug shifts the sleeve to the second position.

8. The downhole apparatus of claim 6, wherein a plug is displaced through the sleeve after it has moved out of the first position.

9. The downhole apparatus of claim 6, wherein in the second position the sleeve traps a rupture disk membrane of the rupture disk against the casing.

10. The downhole apparatus of claim 6, wherein the sleeve is a collet sleeve.

11. The downhole apparatus of claim 6, wherein fluid flow through the screen moves the sleeve from the first to the second position.

12. A buoyancy assist tool comprising:

an outer case;

a sleeve detachably connected in a first position in the outer case;

a rupturable fluid barrier connected in the outer case and configured to burst at a predetermined pressure; and a permeable membrane positioned across a flow passage defined by the sleeve, wherein fluid flow through the permeable membrane detaches the sleeve from the first position in the outer case.

13. The buoyancy assist tool of claim 12 connected in a well casing in a well bore, the buoyancy assist tool comprising the upper end of a buoyancy chamber in the well casing.

14. The buoyancy assist tool of claim 13, further comprising a plug displaced into the casing configured to engage the permeable membrane and move the sleeve into the second position after it is detached from the outer case.

15. The buoyancy assist tool of claim 13, wherein the rupturable fluid barrier is positioned in the outer case below the permeable membrane.

16. The buoyancy assist tool of claim 12, wherein the permeable membrane comprises a screen.

17. The buoyancy assist tool of claim 12, wherein the permeable membrane comprises a dissolvable material.

18. The buoyancy assist tool of claim 12, wherein fluid flow through the permeable membrane pulls the sleeve from the first to the second position in the outer case.

* * * * *